US005379060A

United States Patent [19]

Yoshimura

[11] Patent Number: 5,379,060

[45] Date of Patent: Jan. 3, 1995

[54] INK-JET RECORDING HEAD DEVICE

[75] Inventor: Hisashi Yoshimura, Nara, Japan

[73] Assignee: Sharp Kabushiki Kaisha, Osaka, Japan

[21] Appl. No.: 129,786

[22] Filed: Sep. 29, 1993

Related U.S. Application Data

[63] Continuation of Ser. No. 830,411, Feb. 4, 1992, abandoned.

[30] Foreign Application Priority Data

Feb. 7, 1991 [JP] Japan ..... 3-016642

[51] Int. Cl.[6] ..... B41J 2/045; B41J 2/19

[52] U.S. Cl. ..... 347/71; 347/92

[58] Field of Search ..... 346/140 R; B41J 2/045, B41J 2/19

[56] References Cited

U.S. PATENT DOCUMENTS

| | | | |
|---|---|---|---|
| 4,380,018 | 4/1983 | Andoh et al. | 346/140 R |
| 4,460,906 | 7/1984 | Kanayama | 346/140 R |
| 5,087,930 | 2/1992 | Roy et al. | 346/140 R |

FOREIGN PATENT DOCUMENTS

| | | |
|---|---|---|
| 2161315 | 6/1973 | Germany . |
| 2256413 | 6/1974 | Germany . |
| 60-72245 | 5/1985 | Japan . |
| WO82/01245 | 4/1982 | WIPO . |

OTHER PUBLICATIONS

Patent Abstract of Japan, vol. 13, No. 22 (Jan. 19, 1988).

*Primary Examiner*—Benjamin R. Fuller
*Assistant Examiner*—Alrick Bobb
*Attorney, Agent, or Firm*—David G. Conlin; George W. Neuner

[57] ABSTRACT

An ink-jet recording head device capable of ejecting ink from an orifice opened on a slit, the ink being fed from an ink feeding port provided at a lower location than the orifice by means of pressure generated in response to an electrical signal, includes an ink conducting path for communicating the ink feeding port with the slit. The ink conducting path includes a first conducting path formed to conduct the ink from the ink feeding port to an upper part of the slit and then to return toward the lower part of the slit to be led to the orifice.

3 Claims, 4 Drawing Sheets

INK-JET RECORDING HEAD DEVICE

This is a continuation of copending application Ser. No. 07/830,411 filed on Feb. 4, 1992, now abandoned.

BACKGROUND OF THE INVENTION

1. Field of the Invention

The present invention relates to an ink-jet recording head device of an ink-on-demand type which mainly used for ink-jet printer.

2. Description of the Related Art

The inventor of the present invention knows an ink-jet recording head device which includes a layered product formed by laminating a plurality of plates as a main body, an ink chamber formed in the layered product, a slit formed at a front plate of the layered product, art orifice formed in a place adjacent to the front plate, and an ink conducting path formed in the layered product. The orifice is formed on the center of the slit so that the orifice is communicated with the ink conducting path through the slit.

The ink conducting path is communicated with the ink chamber, which is also communicated with an ink feeding port formed on the lower rear side of the layered product. At the back portion of the layered product, a pressure generating chamber is provided at a lower location of the orifice. The pressure generating chamber is communicated with the orifice through an ink path. The ink path is composed of two horizontal part and one vertical part and is formed like a crank.

The ink conducting path is branched into two ways, one way leading from the lower portion of the layered product to the slit directly and the other way leading from the lower portion of the layered product to the slit around the ink path.

At the rear portion of the pressure generating chamber is provided an oscillator for generating pressure. The oscillator is connected to a voltage supply. When the voltage supply applies a voltage to the oscillator, the oscillator is flexed toward the pressure generating chamber, that is, the front side. The flexing operation results in applying pressure to the ink stored in the pressure generating chamber. The pressure is communicated to the ink conductive path so that the ink is ejected from the orifice through the slit. When the voltage supply stops the application of a voltage, the flexed oscillator is restored so that the volume of the pressure generating chamber is also restored. It results in allowing the substantially same volume of ink as the ejected ink to be sucked into the ink path through the effect of the orifice.

In the ink-jet recording head device having the foregoing arrangement, however, when bubbles are entered into the pressure generating chamber or the ink path, which often takes place in this type head device, those bubbles absorb the generated pressure and thus restrict the ejection of the ink from the orifice. It results in making part of a printed character or figure thinner or lost on paper.

One of the causes why bubbles are entered into the pressure generating chamber or the ink path is that bubbles are gradually generated from the ink when using or saving the recording head device for a long time. For example, the bubbles occurring in the ink contained in the ink conducting path or the ink chamber are attached to the ink conducting path or the ink chamber as well as are flowing to the slit through the ink conducting path and the ink chamber. When the bubbles conducted to the slit are sucked to the pressure generating chamber and the ink path together with the ink when the ink contained in the slit is sucked into the pressure generating chamber. Hence, those sucked bubbles serve to absorb the pressure generated in the pressure generating chamber, resulting in preventing the ejection of the ink from the orifice. It also brings about a phenomenon that part of a character(s) or figure may be thinner or lost.

SUMMARY OF THE INVENTION

It is therefore an object of the present invention to provide an ink-jet recording head which is capable of preventing the bubbles generated in the ink contained in the ink conducting path and the ink chamber from being conducted to the slit.

The object of the invention can be achieved by an ink-jet recording head device capable of ejecting an ink from an orifice opened on a slit, the ink being fed from an ink feeding port provided at a lower location than the orifice by means of pressure generated in response to an electrical signal, including:

an ink conducting path for communicating the ink feeding port with the slit, the ink conducting path including a first conducting path formed to conduct the ink from the ink feeding port to the upper place than the slit and then to the slit.

As mentioned above, the conduction path includes a first conducting path for conducting the ink fed from the ink feeding port to the slit. The ink feeding port is located at the lower place of the orifice opened on the slit. As such, the first conducting path is arranged to conduct the ink to the upper place than the slit and then to the slit. Hence, bubbles occurring in the ink contained in the conducting path are stored at the upper place than the slit. The location results in preventing the conduction of the bubbles occurring in the ink from being conducted to the slit.

It will be understood from the above description that the present invention is the ink-jet recording head device which is capable of ejecting the ink from the orifice opened in the slit by applying the pressure generated in response to an electric signal. The ink conducting path is provided for communicating the slit with the ink feeding port provided at the lower location than the orifice. The first conducting path included in the ink conducting path serves to conduct the ink fed from the ink feeding port to the upper place than the slit and then to conduct the ink to the slit. The arrangement of the ink conducting path results in preventing the conduction of the bubbles taking place in the ink to the slit.

Further objects and advantages of the present invention will be apparent from the following description of the preferred embodiments of the invention as illustrated in the accompanying drawings.

DESCRIPTION OF THE PREFERRED EMBODIMENTS

Figure 1:
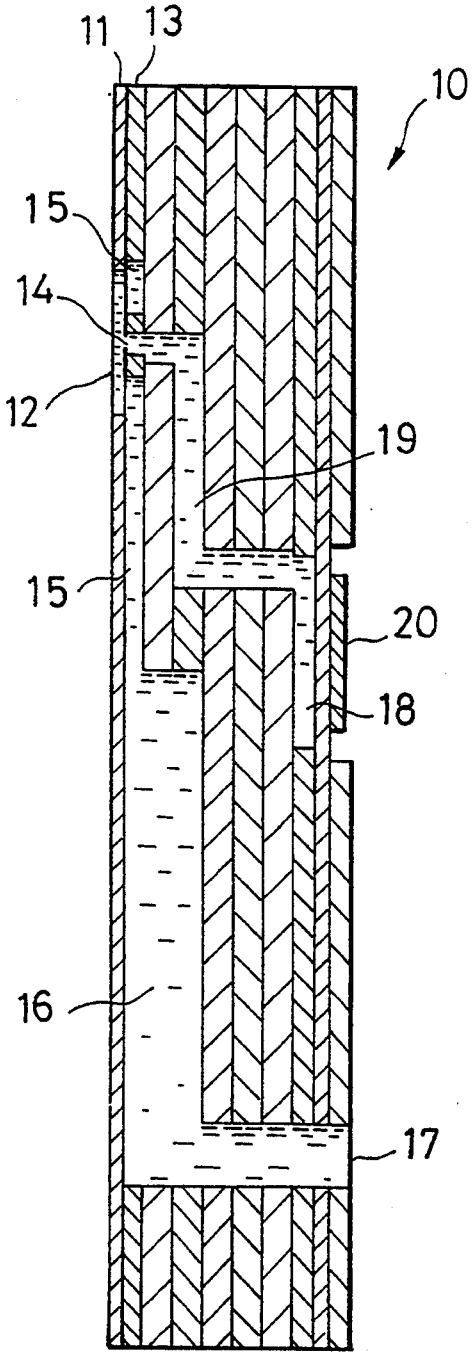
Fig. 1 (PRIOR ART)
FIG. 1 is a sectional view showing an essential portion of an ink-jet recording head device in accordance with the related art.

An embodiment of tile present invention is described hereinafter in detail with reference to the drawings in comparison with the related art structure which is also illustrated and described referring to the drawings.

Figure 2:
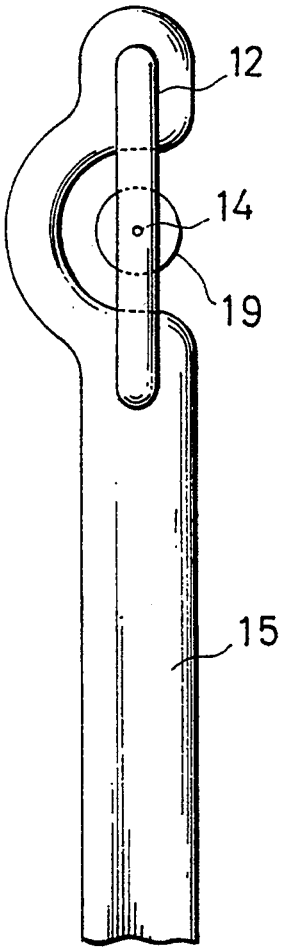
Fig. 2 (PRIOR ART)
FIG. 2 is an elevation view showing the ink-jet recording head device shown in FIG. 1.

FIG. 1 is a sectional view showing an essential portion of an ink-jet recording head device in accordance with the related art. This figure is used for describing an ink feeding path provided in the ink-jet recording head device. FIG. 2 is an elevation view showing an essential portion of the ink-jet recording head device shown in FIG. 1.

As shown in FIGS. 1 to 2, a layered product 10 is formed by laminating a plurality of plates. The layered product 10 has an ink chamber 16 formed therein. A front plate 11 of the layer product 10 has a slit 12. An adjacent plate 13 junctioned with the front plate 11 has an orifice 14 and an ink conducting path 15. The orifice 14 is formed on the center of the slit 12 so that the orifice 14 is communicated with the ink conducting path 15 through the slit 12.

The ink conducting path 15 is communicated with the ink chamber 16, which is also communicated with an ink feeding port 17 formed on the lower back side of the layered product 10. At the back portion of the layered product 10, a pressure generating chamber 18 is provided at a lower location of the orifice 14. The pressure generating chamber 18 is communicated with the orifice 14 through an ink path 19. The ink path 19 is composed of two horizontal parts and one vertical part and is formed like a crank.

As shown in FIG. 2, the ink conducting path 15 is branched into two ways, one way leading from the lower portion of the layered product 10 to the slit 12 directly and the other way leading from the lower portion of the layered product 10 to the slit 12 around the ink path 19.

At the rear portion of the pressure generating chamber 18 is provided an oscillator 20 for generating pressure.

Figure 3:
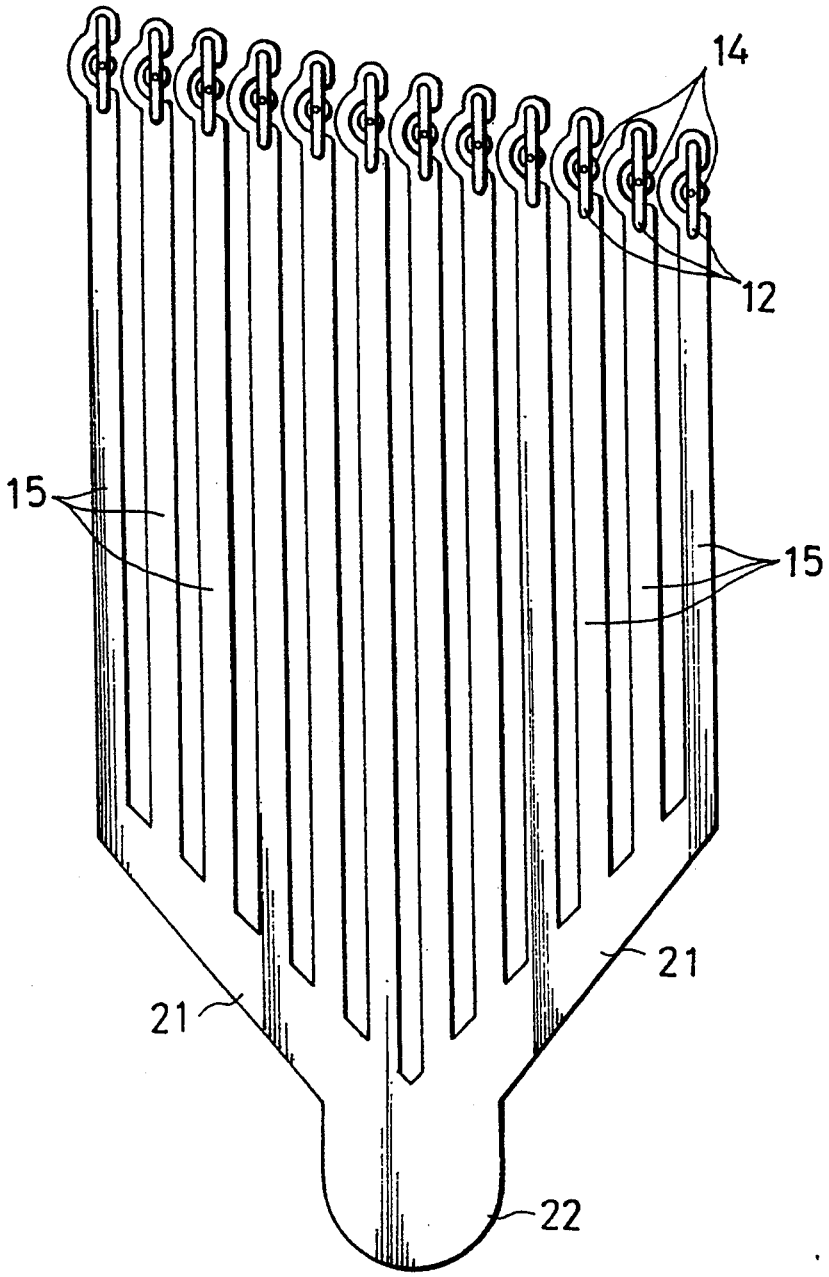
Fig. 3 (PRIOR ART)
FIG. 3 is an elevation view showing a dot recording head device having the ink-jet recording head device shown in FIG. 1 as one unit.

FIG. 3 is an elevation view showing an essential portion of the dot recording head apparatus having as a unit the ink-jet recording head device shown in FIG. 1.

As shown in FIG. 3, each ink conducting path 15 is branched from an ink feeding path 21, which is branched from a pipe path leading to an ink reservoirs chamber (not shown).

Figure 4:
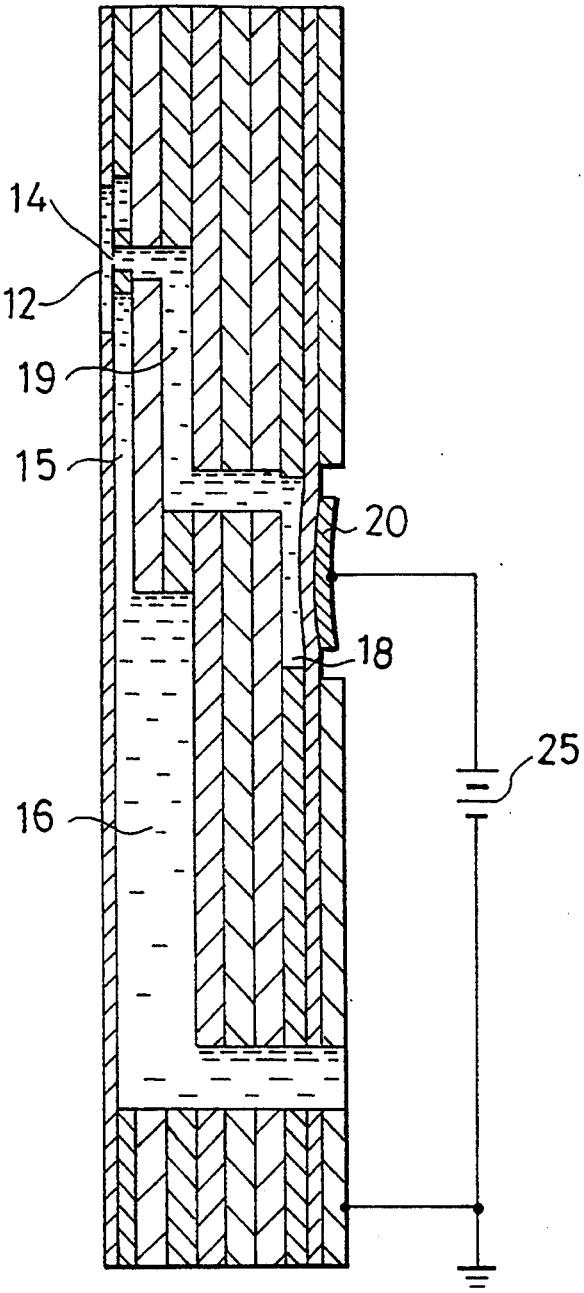
Fig. 4 (PRIOR ART)
FIG. 4 is a sectional view showing an essential portion of the ink-jet recording head device shown in FIG. 1 for describing an operation of the device.

FIG. 4 is a sectional view showing an essential portion of the ink-jet recording head device shown in FIG. 1 for describing the operation of the device.

As shown in FIG. 4, the oscillator 20 for generating pressure is arranged at the rear portion of the pressure generating chamber 18. The oscillator 20 is connected to a voltage supply 25. When the voltage supply 25 applies a voltage to the oscillator 20, the oscillator 20 is flexed toward the pressure generating chamber 18. The flexing operation results in applying pressure to the ink stored in the pressure generating chamber 18. The pressure is communicated along the ink path 19 so that the ink is ejected from the orifice 14 through the slit 12. When the voltage supply 25 stops the application of a voltage, the flexed oscillator 20 is restored so that the volume of the pressure generating chamber 18 is also restored. It results in allowing the substantially same volume of ink as the ejected ink to be sucked into the ink path 19 through the effect of the orifice 14.

In the ink-jet recording head device having the foregoing arrangement, however, when bubbles are entered into the pressure generating chamber 18 or the ink path 19, which often takes place in this type head device, those bubbles absorb the generated pressure, and thus restrict the ejection of the ink from the orifice I4. It results in making part of a printed character or figure thinner or lost on paper.

One of the causes why the bubbles are entered into the pressure generating chamber 18 or the ink path 19 is that the bubbles are gradually generated from the ink when using or saving the recording head device for a long time. For example, the bubbles occurring in the ink contained in the ink conducting path 15 or the ink chamber 16 are attached to the ink conducting path 15 or the ink chamber 16 as well as are flowing to the slit 12 through the ink conducting chamber 15 and the ink chamber 16. When the bubbles conducted to the slit 12 are sucked to the pressure generating chamber 18 and the ink path 19 together with the ink when the ink contained in the slit 12 is sucked into the pressure generating chamber 18. Hence, those sucked bubbles serve to absorb the pressure generated in the pressure generating chamber 18, resulting in preventing the ejection of the ink from the orifice 14. It also brings about a phenomenon that part of a character(s) or figure may be thinner or lost.

In turn, the description will be directed to an ink-jet recording head according to an embodiment of the present invention, which is improved to avoid the phenomenon.

Figure 5:
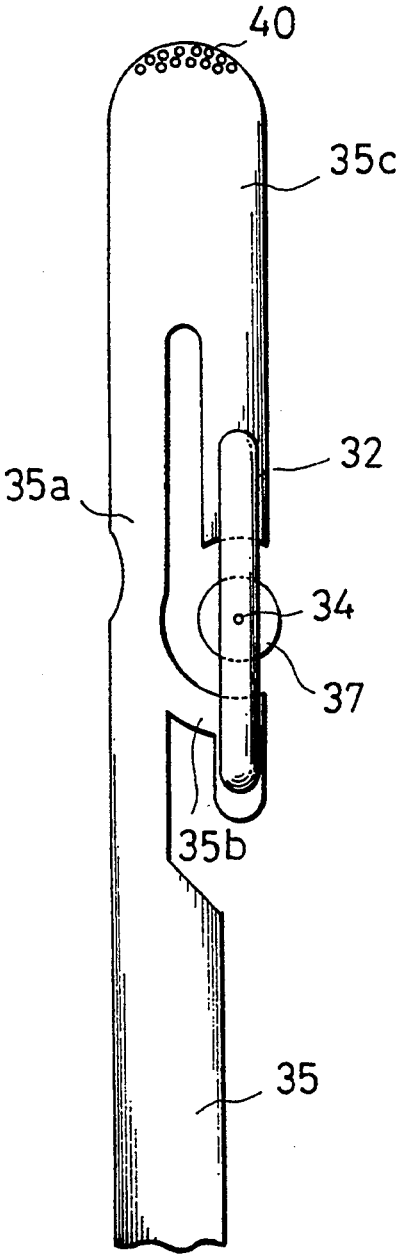
FIG. 5 is an elevation view showing an essential portion of an ink-jet recording head device according to an embodiment of the present invention.
Figure 6:
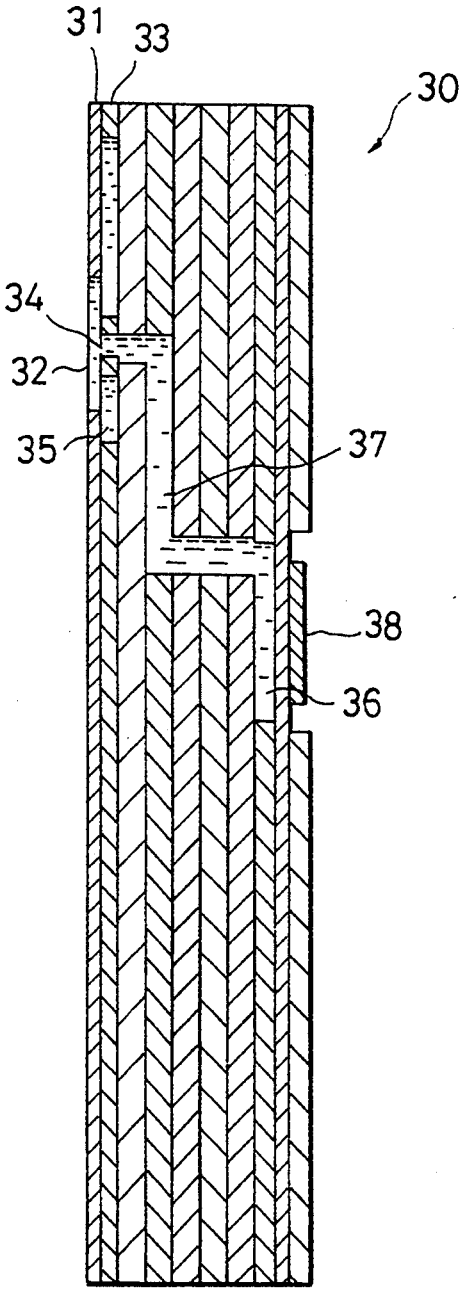
FIG. 6 is a sectional view showing the ink-jet recording head device shown in FIG. 5.

FIG. 5 is an elevation view showing an arrangement of an ink-jet recording head device for an ink-jet printer according to an embodiment of the present invention. FIG. 6 is a sectional view showing an essential part of the ink-jet recording head device. This figure is used for describing an ink feeding path provided in the ink-jet recording head device shown in FIG. 5.

As shown in FIGS. 5 and 6, a reference numeral 30 denotes a layered product formed by laminating a plurality of plates. A reference numeral 31 denotes a front plate included in the layered product 30. The front plate 31 has a slit 32 formed therein. A reference numeral 33 denotes an adjacent plate junctioned with the front plate 31. The adjacent plate 33 includes an orifices, 34 and an ink conducting path 35 formed therein. The orifice 34 is communicated with the ink conducting path 35 through the slit 32. The orifice 34 is formed on the center of the slit 32.

The ink conducting path 35 is communicated with the slit 32 and an ink feeding port (not shown) through an ink chamber (not shown). The ink chamber is formed inside of the layered product 30 and the ink feeding port is formed at the lower back side of the layered product 30.

At the rear side of the layered product 30, the pressure generating chamber 36 is provided at the lower location than the orifice 34. The pressure generating chamber 36 is communicated with the orifice 34 through an ink path 37. The ink path 37 is composed of two horizontal parts and one vertical part and is formed like a crank.

It will be understood from FIG. 5 that the ink conducting path 35 extends from the lower side to the upper side of the layered product 30 and is branched at a point around the slit 32 and at the lower portion of the orifice 34. One branched ink conducting path 35*b* extends from the branch point to the lower side along the ink path 37, finally being led to the slit 32.

The other branched ink conducting path 35*a* extends along the slit 32 from the branch point to the upper of the slit 32 and then is returned to the lower portion, finally being led to the slit 32. A reference numeral 35*c* denotes the conducting path formed like a reverse U shape at the upper of the layered product 30. The returned point at which the ink conducting path 35*c* returns from the upper direction of the slit 32 to the lower direction may be provided within the upper range of 50 mm from the orifice 34, for example.

At the rear of the pressure generating chamber 36, there is provided an oscillator 38 for generating pressure.

The layered product 30 is formed by laminating a plurality of plates. Each plate is made of stainless or photosensitive glass. The orifice, the paths and the chambers are etched on the corresponding plates. However, it may use a mold made of silicon wafer or resin.

The oscillator 38 may be composed of a stainless steel plate and one piezoelectric body polarized toward the direction of thickness of the layered product. As another example, the oscillator 38 may be arranged by molding PZT (zircon lead titanium) as a chip, sintering the mold, polarizing the sintered mold and forming an electrode. In actual, the oscillator 38 may employ various oscillating elements without being limited to these examples. Further, another kind of pressure generating element, for example, the bubbles generated in a thermal chip may be used for applying pressure to the orifice.

Figure 7:
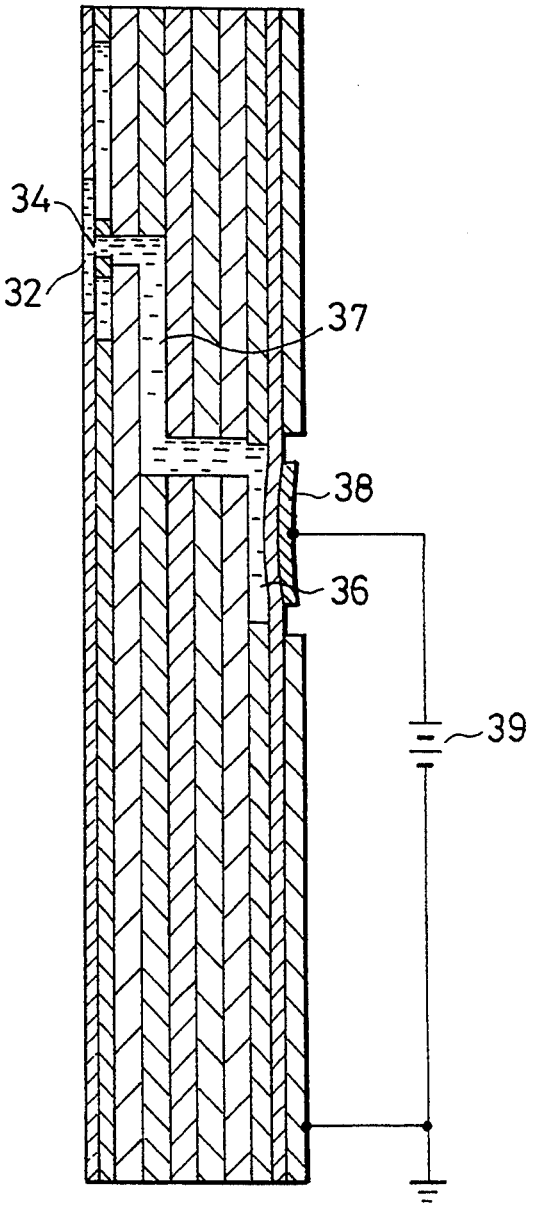
FIG. 7 is a sectional view showing an essential portion of the ink-jet recording head device shown in FIG. 5 for describing an operation of the device.

Turning to FIG. 7, this figure is a sectional view of an essential portion of the ink-jet recording head device for describing the operation of the device.

As shown in FIG. 7, when a voltage supply 39 applies a voltage to the oscillator 38, the oscillator 38 is flexed toward the pressure generating chamber 36, resulting in applying pressure on the ink stored in the pressure generating chamber 36.

This pressure is transmitted through the ink path 37 so that it ejects the ink out of the orifice 34 through the slit 32.

When the voltage supply 39 stops the application of a voltage to the oscillator 38, the oscillator 38 is returned from the flexed state to the original state, resulting in restoring the volume of the pressure generating chamber 36. Hence, the substantially same volume of ink as the ejected ink is sucked into the ink path 37 through the slit 32 and the orifice 34.

In case of sucking the ink, bubbles may take place in the ink stored in the ink conducting path 35 and the ink chamber and be conducted to the slit 32 located at the upper place along the stream of the ink. It results in the bubbles being sucked into the pressure generating chamber 36 and the ink path 37 together with the ink and being entered into the pressure generating chamber 36 and the ink path 37.

In the construction according to this embodiment, as shown in FIG. 5, the bubbles 40 taking place in the ink contained in the ink conducting path 35 and the ink chamber are moved toward the upper place along the stream of the ink along the ink conducting paths 35 and 35*a*, because the bubbles are lighter than the ink. The bubbles 40 are stored in the reverse-U-formed portion of the ink conducting path 35*c*. Moreover, the ink conducting path 35b is directed from the branch point to the lower place with respect to the slit 32. Hence, the construction prevents the bubbles 40 from being conducted to the orifice 34 and the slit 32.

Those advantageous construction inhibits conduction of the bubbles 40 occurring in the ink stored in the ink conducting path 35 and the ink chamber to the slit 32. When the ink contained in the slit 32 is sucked into the pressure generating chamber 36, therefore, the bubbles 40 are disallowed to be sucked together with the ink. The bubbles 40 never suck the pressure generated in the pressure generating chamber 36 when a voltage is applied to the oscillator 38 by the voltage supply 39, resulting in keeping the ink being ejected without fail. As a result, lack of a printed character or figure on paper may be prevented.

Many widely different embodiments of the present invention may be constructed without departing from the spirit and scope of the present invention. It should be understood that the present invention is not limited to the specific embodiments described in the specification, except as defined in the appended claims.

What is claimed is:

1. An ink-jet recording head device comprising:

a laminated body formed by a plurality of plates;

a slit formed in said laminated body;

an orifice opened on said slit for ejecting an ink; and an ink conducting path formed in said laminated body so as to communicate with said orifice, said ink conducting path having a branch point which is located between a lower end of said slit and said orifice, by which said ink conducting path is divided into two branches, a first branch having a straight portion extending along said slit from said branch point over an upper end of said slit, a reverse U-shaped portion connecting between said straight portion and said upper end of said slit, a bottom portion of said reverse U-shaped portion being located above said slit for storing bubbles; and a second branch extending from said branch point toward the lower end of said slit and being connected to said lower end of said slit.

2. An ink-jet recording head device according to claim 1, further comprising an oscillator for generating an electrical signal, and means for receiving said generated electrical signal and pressurizing the ink to be supplied to said orifice through an ink path in response to said received electrical signal.

3. An ink-jet recording head device according to claim 2, wherein said oscillator comprises a stainless steel plate and a piezoelectric body polarized toward a direction of thickness of the laminated body.

* * * * *